US006368071B1

(12) United States Patent
Hashida et al.

(10) Patent No.: US 6,368,071 B1
(45) Date of Patent: Apr. 9, 2002

(54) HIGH PRESSURE FUEL PUMP

(75) Inventors: Minoru Hashida; Yukio Takahashi; Yoshinobu Ono; Hideki Machimura; Takefumi Yamamura; Masayoshi Kotaki, all of Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/414,648

(22) Filed: Oct. 8, 1999

(30) Foreign Application Priority Data

Oct. 8, 1998 (JP) ..... 10-286756

(51) Int. Cl.[7] ..... F04B 1/12

(52) U.S. Cl. ..... 417/269; 417/547; 417/567; 417/569

(58) Field of Search ..... 417/269, 545, 417/547, 554, 569, 567

(56) References Cited

U.S. PATENT DOCUMENTS 3,455,585 A * 7/1969 Raymond ..... 417/269
3,663,122 A * 5/1972 Kitchen ..... 417/269
4,642,032 A * 2/1987 McBeth ..... 417/269
5,320,498 A * 6/1994 Fuchida ..... 417/554
5,370,505 A * 12/1994 Takenaka et al. ..... 417/269
5,466,130 A * 11/1995 Kobelt ..... 417/269
5,601,345 A * 2/1997 Tackett ..... 303/116.4
5,647,266 A * 7/1997 Claas ..... 417/269

FOREIGN PATENT DOCUMENTS

JP 9-236080 9/1997
JP 9-250447 9/1997

* cited by examiner

*Primary Examiner*—Cheryl J. Tyler
(74) *Attorney, Agent, or Firm*—Crowell & Moring LLP

(57) ABSTRACT

An axial plunger pump includes a shaft having a swash plate effecting swing motion and transmitting driving force from the outside, plungers reciprocate by the swing motion of the swash plate. A cylinder block has cylinders formed so as to open on the side of the swash plate, with the plungers inserted therein. Passages in the block supply refuel to the cylinders. A body combined with the cylinder block encloses the swash plate. Sealing members are arranged between the plungers and the cylinders on the swash plate side of the passages formed in the cylinder block for sealing gaps between the plungers and the cylinders, respectively.

2 Claims, 5 Drawing Sheets

(a) INTAKE STROKE (b) DISCHARGE STROKE

HIGH PRESSURE FUEL PUMP

BACKGROUND OF THE INVENTION

The present invention relates to a fuel pump for fuel supply of an internal combustion engine and, more particularly, to a high pressure fuel pump used for a fuel injection system of a so-called direct fuel injection type internal combustion engine, which system injects directly fuel from a fuel injection valve mounted on a combustion chamber into the combustion chamber.

For an internal engine in which fuel is directly injected into the combustion chamber, it is necessary to have a high pressure pump for raising the pressure of fuel to be supplied to an fuel injection valve to a pressure of 2 MPa or more.

As such a high pressure pump, there has been known a conventional axial plunger pump which is disclosed in JP A 9-236080. Such a conventional axial plunger pump is constructed so as to partition a driving mechanism part lubricated with oil and a pump chamber compressing and discharging fuel by a metal bellows.

Further, a conventional high pressure fuel pump disclosed in JP A 9-250447 is constructed so as to circulate fuel also to a sliding portion of a driving mechanism part, and the driving mechanism part, that is, the sliding portion is lubricated with fuel.

SUMMARY OF THE INVENTION

The above-mentioned conventional high pressure fuel pumps have the following problems or disadvantages.

1. The former conventional pump has a problem that the pump is large-sized because of use of the metal bellows and it is difficult to make the pump size small because it is necessary to provide a seal portion on a bellows mounting portion.
2. In the latter conventional pump, it is not necessary to provide any bellows, however, lubrication is insufficient because the sliding portion of the driving mechanism part is lubricated with fuel of low viscosity.

An object of the present invention is to provide an axial plunger pump in which any bellows is unnecessary and lubrication of a sliding portion of a driving mechanism part is sufficient.

Another object of the present invention is to enable a roll bearing to be used in the driving mechanism part.

In order to solve the above problems, an axial plunger pump according to the present invention is constructed so as to comprise a shaft having a swash plate effecting swing motion and transmitting driving force from the outside, plungers each reciprocating by the swing motion of the swash plate, a cylinder block having cylinders formed so as to open on the side of the swash plate and inserting therein the plungers and having passages for supplying fuel to the cylinders, a body combined with the cylinder block to enclose the swash plate, and sealing members arranged between the plungers and the cylinders on the swash plate side of the passages formed in the cylinder block for sealing gaps between the plungers and the cylinders, respectively.

Another invention is a high pressure fuel pump which comprises a shaft having an swash plate effecting swing motion, and transmitting driving force from the outside, a plurality of plungers each reciprocating by the swing motion of the swash plate a cylinder block having cylinders formed so as to open on the side of the swash plate and inserting therein the plungers, the cylinder block having passages for supplying fuel to the cylinders, a body combined with the cylinder block to enclose the swash plate, a radial bearing supporting the shaft mounted on the body and a bearing arranged on the back of the swash plate for supporting an axial load applied on the swash plate, which bearing is a thrust roll bearing having rolls or balls larger in rolling pitch diameter than the radial bearing.

Still another invention is a plunger for a high pressure fuel pump, which plunger has a radial hole traversing the central axis of the plunger, a groove formed on the periphery so as to overlap with the radial hole and having a prescribed axial length, and an end portion to which an axial hole communicating with the radial hole is opened and the other end portion is formed spherical.

DESCRIPTION OF EMBODIMENTS OF THE INVENTION

Figure 1:
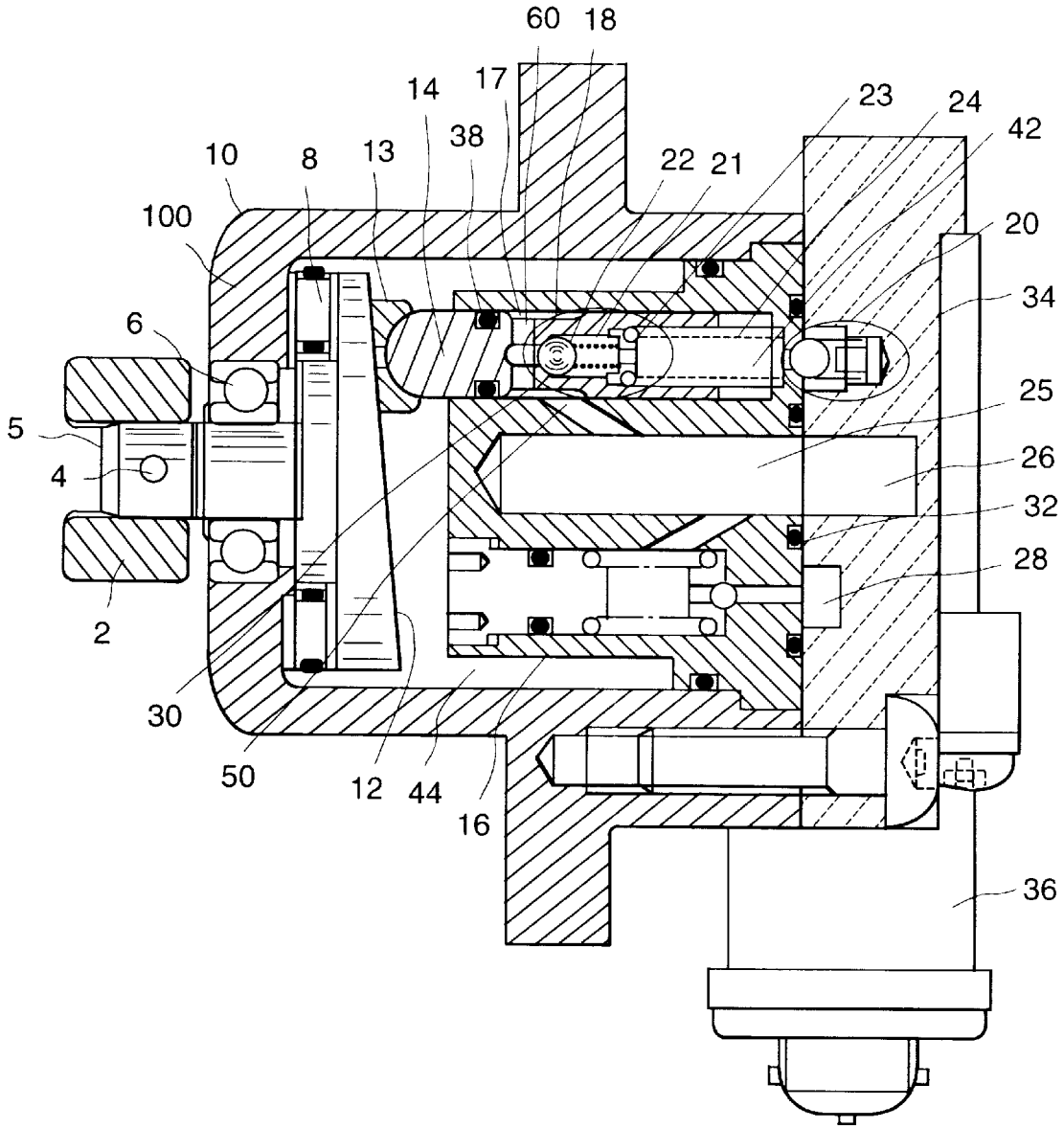
FIG. 1 is a sectional view of a high pressure fuel pump of a first embodiment of the present invention.
Figure 2:
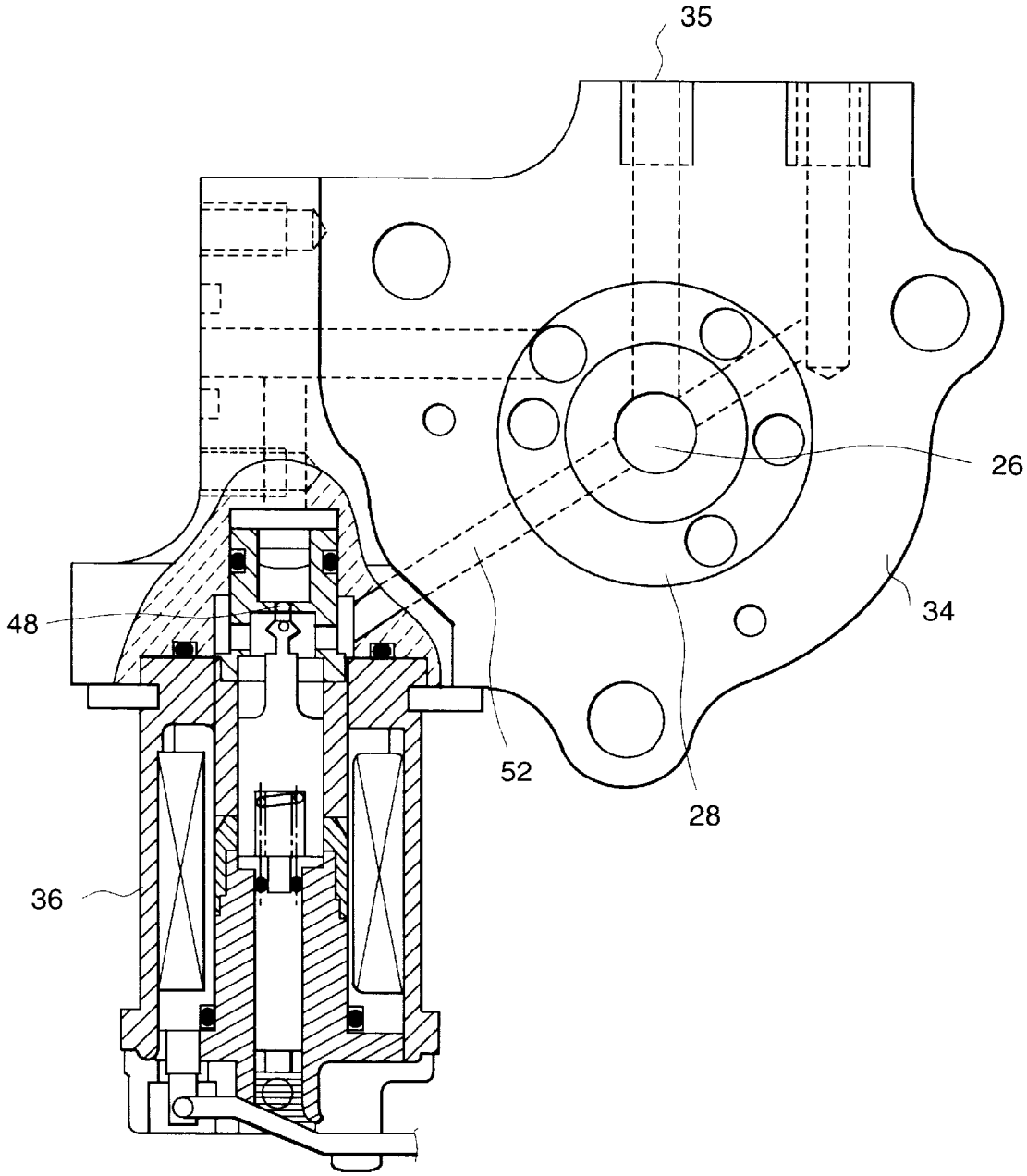
FIG. 2 is a partially sectional view of a construction of passage in a rear body of the first embodiment.

A high pressure fuel pump of a first embodiment of the present invention is shown in FIGS. 1 and 2.

In FIG. 1, a coupling 2 for transmitting drive force transmitted from a cam shaft of an engine to the pump has a shaft 5 connected by a pin 4 fitted to the coupling 2. The shaft 5 has thereon a swash plate 12 which radially expands and which is formed in oblique flat plane at its end. The swash plate 12 is in contact with slippers 13 at the oblique flat plane and the slippers 13 each are formed substantially flat so that the slippers 13 can smoothly slide on the swash plate 12 rotating together with the shaft 5. The slippers 13 each are formed in spherical shape on the other side, and swinging motion of the swash plate 12 imparts reciprocating motion to a plurality of plungers 14 each sliding in a cylinder bore 17 of a cylinder block 16.

With the pump of the above construction, intake and discharge of fuel is carried out as follows.

The plurality of cylinder bores 17 and plungers 14 form a plurality of pump chambers 42. An intake space 25 communicating with each plunger 14 is provided at the center of the cylinder block 16 so as to supply fuel to the pump chambers 42. In order to introduce fuel into the intake space 25, fuel piping is provided out of the pump, and the fuel is led to the intake space 25 through an intake passage 35 formed in a rear body 34 and an intake chamber 26 formed at the center of the rear body 34 and connected to the intake space 25.

In each plunger 14, an intake valve 18 (a check valve) is disposed, and the intake valve 18 is formed of a ball 22, a spring 21 and a stopper 23 supporting the spring 21. A plunger spring 24 is inserted for the purpose of causing the plunger 14 to follow the slipper 13 and the swash plate 12. The stopper 23 is also used for supporting spring force of the plunger spring 24.

A communication passage 50 to the plunger intake valve 18 is formed as an oblique passage which is inclined against an axial direction and led from the intake space 25 to the cylinder side. An intake groove 30 is formed in the outer periphery of the plunger 14 so that even if th plunder reciprocates, the communication passage 50 and the intake valve 18 are always communicated, that is, they are communicated over the full stroke of the plunger 14. Concretely, the groove of width larger than the stroke of the plunger is formed. Since it is simple in construction because of groove formation without use of any other devices, it serves for making the construction small in size.

Figure 3:
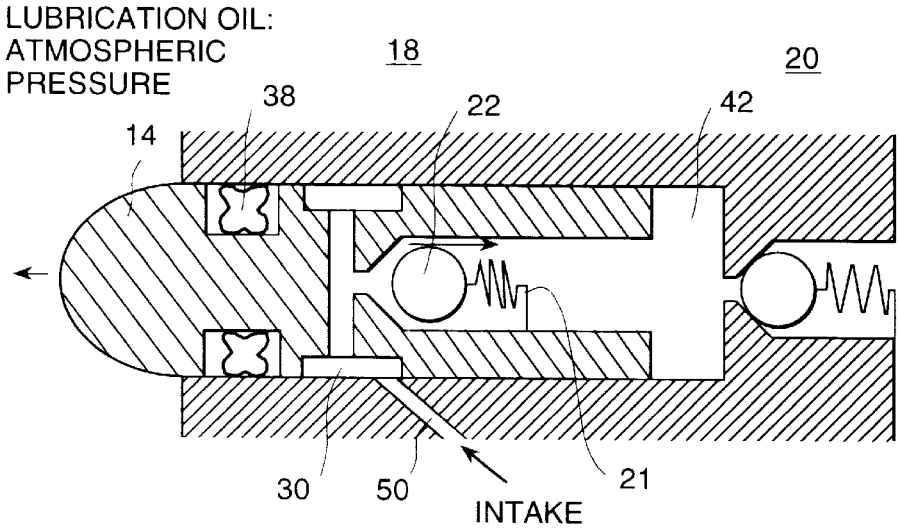
FIGS. 3*a* and 3*b* each are a sectional view of a plunger and a surrounding portion thereof for explaining strokes.
Figure 3:
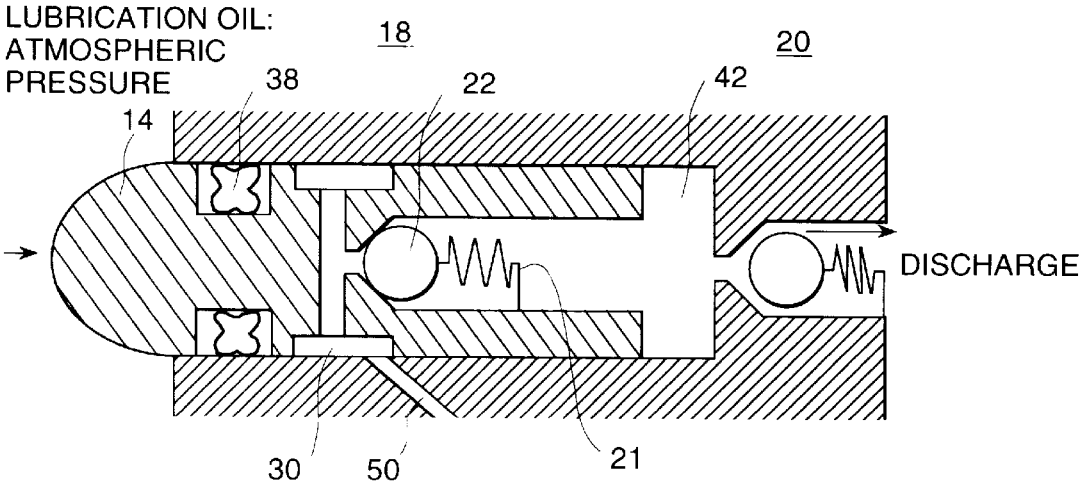

FIG. 3 shows an enlarged view of the plunger 14 for explanation of strokes. When the above-mentioned intake stroke is turned to a discharge stroke (a stroke in which the space of the pump chamber 42 decreases) and when the pressure in a discharge chamber 28 formed in the rear body 34 reaches to a prescribed pressure, a discharge valve 20 constructed of a ball 22 and a spring 21 as well as the intake valve 18 formed in the cylinder block 16 is opened, and the fuel supplied to the pump chamber 42 formed by the cylinder and the plunger 14 during the above-mentioned intake stroke is discharged from the pump chamber 42. Here, the intake chamber 26 and discharge chamber 28 are separated by an O-ring 32, the intake chamber 26 is provided on the central side more than the discharge chamber 28, whereby a passage construction in the pump itself is made compact.

The pressure in the discharge chamber 28 of the rear body 34 can be controlled to an optimum pressure by a pressure regulator 36 provided on the discharge side. The purpose of controlling the discharge pressure is for controlling the pressure applied to an injector (not shown) disposed downstream of the discharge side. Excess high pressure side fuel supplied form the high pressure chamber of the rear body 34 to the pressure regulator 36 is returned to the intake chamber 26 through a ball valve 48 provided in the pressure regulator 36 and a communication passage 52 provided in the rear body 34. The intake passage 35, intake chamber 26, intake space 25 and communication passage 50 form passages for supplying fuel from a fuel source to each cylinder.

In this manner, the fuel pressure in the pump chamber 42 also changes from an intake pressure (in general, 0.2 MPa to 0.5 MPa) to pressure in the high pressure chamber (in general, 3 MPa to 20 MPa). A load generated by the fuel pressure in the pump chamber 42 is transmitted to the swash plate 12 of the shaft 5 through the slippers 13. The load to the slippers 13 is transmitted from each plunger 14 and transmitted to the swash plate 12. On the other hand, the resultant force of forces of the plurality of plungers 14 is applied to the shaft 5. The resultant force acts as axial force and radial load according to the inclination angle of the swash plate 12. In order to support those loads and achieve smooth rotation, the radial bearing 6 and the thrust bearing 8 are fitted to the shaft 5, and the loads are supported by the body 10.

Portions (the slippers 13/the swash plate 12 and the bearing portions) supporting those loads are portions at which a relative speed due to rotation exists and loads are supported. By lubricating those portions, wear due to sliding can be decreased. It, therefore, is necessary to provide a construction for storage of oil in the swash plate chamber 44 formed between the body 10 and cylinder block 16.

In this embodiment, therefore, a shaft seal 38 sealing fuel and oil when the plungers 14 reciprocate is provided on the slipper side of the intake groove 30 of the plunger 14. The shaft seal 38 is for sealing a gap between the plunger 14 and the cylinder bore 17 and it is a boundary between fuel and oil. By constructing in this manner, intake pressure of low pressure on the side of the intake groove 30 is always applied to the shaft seal 38. The intake pressure does not largely change as the pressure in the pump chamber 42, a constant pressure is applied on the shaft seal 38. This construction raises the sealing performance and reliability of the shaft seal 38.

In this embodiment, one shaft seal 38 is provided on the plunger 14, however, the same effect can be attained even by providing it on the cylinder side and also it can be attained by providing a plurality of shaft seals.

On the other hand, the shaft seal 38 of the plunger 14 becomes a resistance against reciprocation of the plunger 14. In the pump construction of the present embodiment, in order to raise the property that the plunger 14 follows the slippers 13 and swash plate 12, the plunger spring 24 is provided, and it is necessary to lower the resistance at the portion of the shaft seal 38. In order to decrease the slide friction resistance due to the seal at the portion of the shaft seal 38, it is important to elect material of low friction coefficient and to elect a suitable shape.

Figure 4:
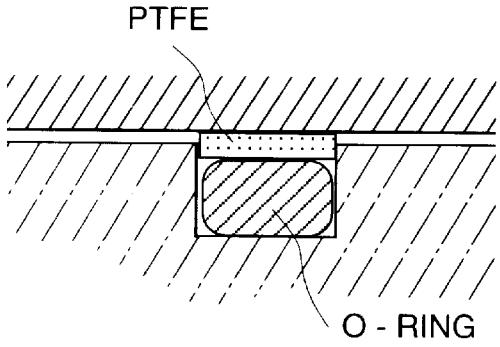
FIG. 4 is a sectional view of a shaft seal of a first embodiment.

FIG. 4 shows seals of such a shape. Material of PTFE which is small in friction coefficient is used on the sliding surface side.

Figure 5:
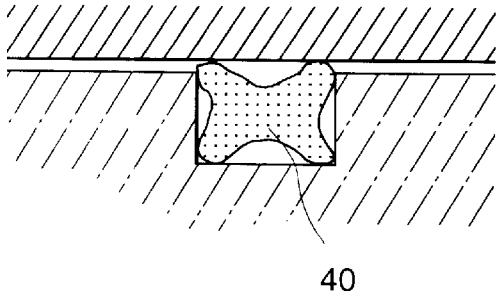
FIG. 5 is a sectional view of a shaft seal of a second embodiment.

FIG. 5 shows an X-shaped rubber seal which is reduced in sliding surface area. In view of being high in circumference temperature in use of the pump, fluorine-contained rubber is used for the rubber material.

Figure 6:
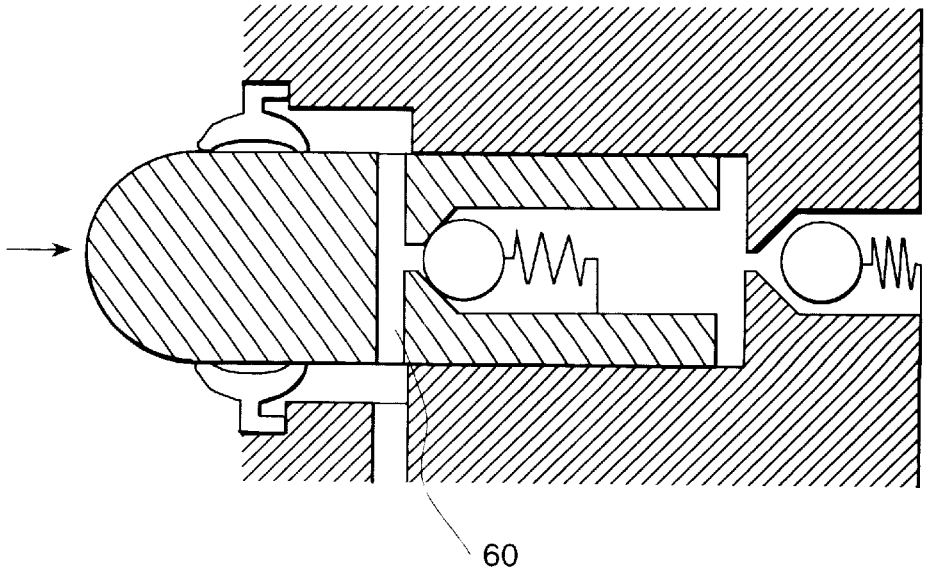
FIG. 6 is a sectional view of a shaft seal of a third embodiment.

FIG. 6 shows a rip seal of another embodiment of the seal member. Further, instead of formation of the intake groove 30, a counterbore is formed in the cylinder bore 17. The counterbore is a bore of larger diameter than the diameter of the cylinder bore 17, and in order that fuel can be sufficiently introduced into the plunger 14, the counterbore is formed to the depth of such extent as the counterbore can communicate with an introduction hole 60 even when the pump chamber 42 becomes sufficiently small. If fuel can be sufficiently introduced into the plunger 14 in this manner even when the displacement of the pump chamber 42 is reduced to a sufficiently small one, the communication passage A 50 is unnecessary to be oblique.

In order to lubricate the driving mechanism portion with fuel as in a conventional manner, it is necessary for all the bearings to be slide bearings. Therefore, excess drive torque due to the slide friction resistance becomes necessary (the viscosity coefficient of fuel is low, particularly, since oil film formation is difficult at a low speed operation, frictional resistance becomes extremely large).

However, as mentioned above, by a construction separating oil and fuel within the reciprocating portion, it is possible to lubricate the inside of the swash plate chamber 44 with oil. Further, in the present embodiment, leakage of oil onto the fuel side is prevented by making the pressure in the swash plate chamber 44 less than the intake fuel pressure, whereby the oil is prevented from being decreased in amount.

By the construction in which oil is always stored in the swash plate chamber 44 in this manner, it becomes possible to use roll bearings for the bearings supporting the above-mentioned loads. Particularly, it is possible to use the roll bearings for the thrust bearings, whereby reduction of the drive torque and the reliability of the siding portion can be improved.

However, the shaft seal 38 inside the reciprocating portion of the plunger 14 diffuses the fuel adhered to the surface of the plunger 14 into oil in a thin layer. Oil in the swash plate chamber 44 is inserted when the pump is assembled, and it is necessary to introduce, into the pump, oil on the side of engine, used on the cam shaft side during engine driving operation after it is mounted on the engine. In order to introduce engine oil into the pump, in the present embodiment, any shaft seal is not provided so that the oil can be introduced from the radial bearing portion 6 of the shaft 5. Therefore, if oil is introduced from the radial bearing portion 6 to an upper portion, oil leaks from a gap between the shaft 5 and the radial bearing 6 to the engine side. If an amount of oil introduced therein is more than the leaked oil, the oil is stored to a level higher than the radial bearing portion 6. Further, in this embodiment, a ball bearing is used for the radial bearing 6, however, a roll bearing also can be used therefor. Since the radial bearing 6 is small in load and used in oil, a slide bearing also can be used therefor.

Even if an amount of oil stored is a level lower than the radial bearing 6, in order that rotating members are always submerged in the oil, a pitch circle of rolls (or rolling pitch circle of balls) of the thrust bearing 8 and the outer diameter of the swash plate 12 are made larger than radial bearing 6. The slippers 13 contacting with the swash plate 12 and converting swinging motion to reciprocation also is lubricated with oil adhered to the swash plate 12, whereby the swash plate portion is able to be lubricated with oil.

Figure 7:
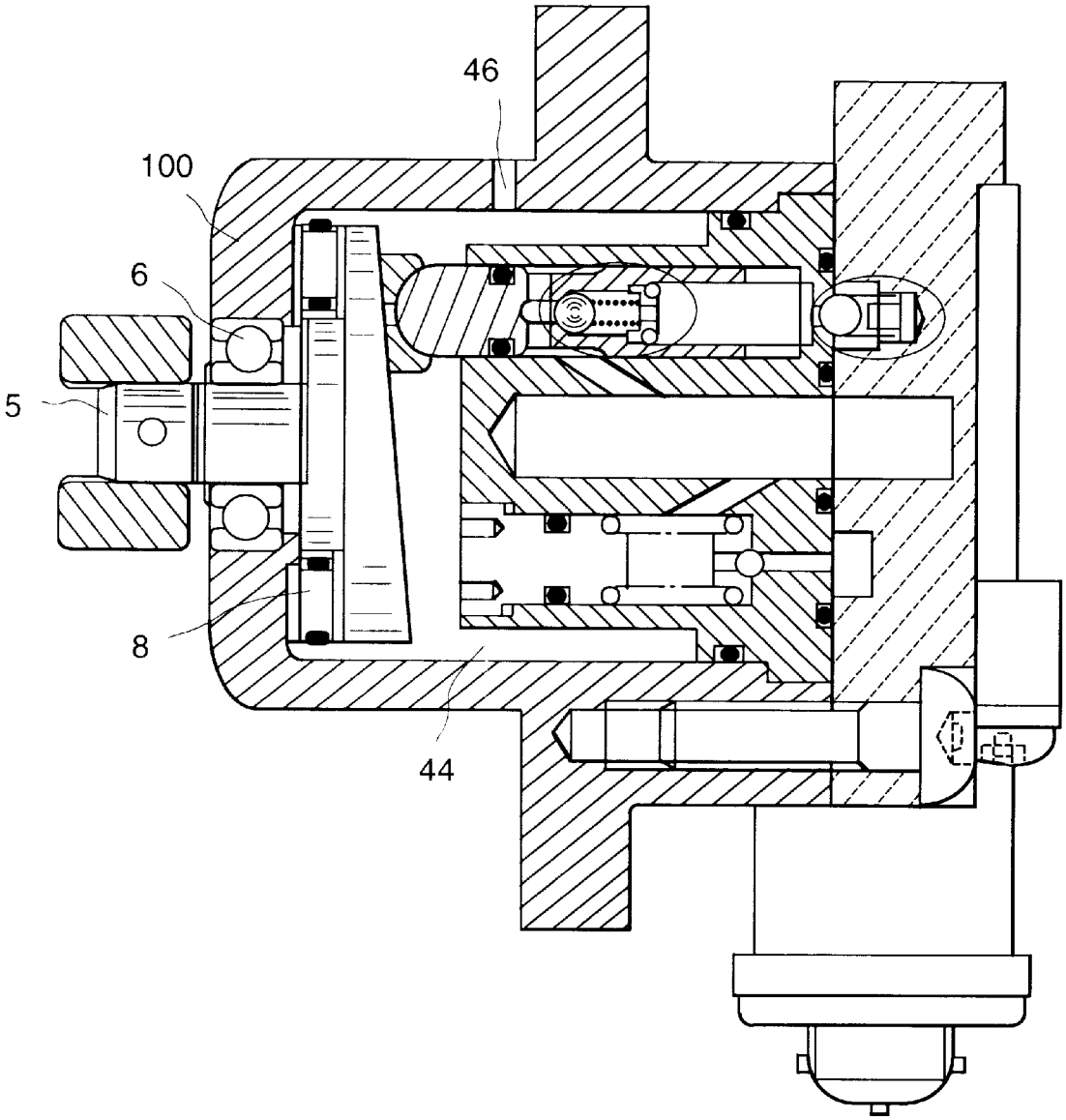
FIG. 7 is a sectional view of a high pressure fuel pump of a second embodiment of the present invention.

FIG. 7 show a second embodiment in which an oil introduction passage 46 for positively introducing oil on the engine into the swash plate chamber 44 is provided. The oil introduction passage 46 is provided on the body 100. In this case, the pressure on the oil introduction side is made higher than the oil pressure in the swash plate chamber 44. Here, the pressure in the swash plate chamber 44 is made smaller than the fuel intake pressure as shown in the first embodiment. Further, the engine oil introduce is returned to the engine side from the radial bearing 6 portion at the center of shaft 5. Foreign matters contained in the oil introduced from the engine side are scattered toward the body inner side by centrifugal force due to rotation of the shaft 5, so that portions of the thrust bearing 8 and radial bearing fitted to the shaft 5 can be lubricated with clean oil.

Since a member such as bellows and a seal member provided at the mounting portion thereof in order to separate an oil circulation portion and a fuel circulation portion become unnecessary, the pump body can be made small in size. Further, since the swash plate portion can be lubricated with lubrication oil, roll bearings can be used for bearings, therefore, frictional resistance at a low speed can be reduced, so that small driving torque is sufficient for driving.

What is claimed is:

1. A high pressure fuel pump comprising:

a shaft having a swash plate effecting swing motion, and transmitting driving force from the outside;

plungers each reciprocating by the swing motion of said swash plate;

a cylinder block having cylinders formed therein so as to open on a side of said swash plate and inserting therein said plungers to form pump chambers, said cylinder block having passages for supplying fuel to said cylinders, said passages being fluidly connected to said pump chambers through fuel passages formed inside said plungers, respectively;

valves provided on said fuel passages, respectively;

a body combined with said cylinder block to form a swash plate chamber accommodating therein said swash plate; and sealing members arranged between said plungers and said cylinders for sealing gaps between said plungers and said cylinders, respectively, said sealing members being axially separated from said passages toward said swash plate, whereby said swash plate chamber is fluidly separated from said fuel passages, wherein grooves are formed in the peripheries of said plungers so that said fuel passages arranged inside said plungers are always communicating with said passage for supplying fuel to said cylinder; said valves are configured to allow communication between said pump chambers and said fuel passages arranged inside said plungers when fuel is a first pressure or higher; and the fuel is supplied to said pump chambers through said plungers.

2. A plunger for a high pressure fuel pump, having;

a closed, spherically-formed end portion, and opened other end portion;

a groove portion formed on the plunger's periphery between said closed end portion and said open end portion, and having a predetermined axial length;

a passage formed inside said plunger and fluidly connecting said groove portion and said open end portion, said passage composed of a radial hole traversing an axis of said plunger and communicating with said groove and an axial hole extending axially from said radial hole to said open end portion; and a valve provided on said axial hole of said passage, said valve comprising a valve member contactable with a valve seat portion of said plunger, a spring urging said valve member on said valve seat and a support member fixed to said plunger for supporting said spring.

* * * * *